US010940658B2

(12) United States Patent
Lemmens

(10) Patent No.: US 10,940,658 B2
(45) Date of Patent: Mar. 9, 2021

(54) CUTTING MECHANISM FOR A DUNNAGE CONVERSION MACHINE AND METHOD

(71) Applicant: Ranpak Corp., Concord Township, OH (US)

(72) Inventor: Peter L. C. Lemmens, Gronsveld (NL)

(73) Assignee: Ranpak Corp., Concord Township, OH (US)

( * ) Notice: Subject to any disclaimer, the term of this patent is extended or adjusted under 35 U.S.C. 154(b) by 113 days.

(21) Appl. No.: 16/097,478

(22) PCT Filed: Apr. 6, 2017

(86) PCT No.: PCT/US2017/026309

§ 371 (c)(1),
(2) Date: Oct. 29, 2018

(87) PCT Pub. No.: WO2017/189201

PCT Pub. Date: Nov. 2, 2017

(65) Prior Publication Data

US 2019/0091959 A1 Mar. 28, 2019

Related U.S. Application Data

(60) Provisional application No. 62/329,291, filed on Apr. 29, 2016.

(51) Int. Cl.
*B31D 5/00* (2017.01)
*B26D 7/22* (2006.01)
(Continued)

(52) U.S. Cl.
CPC ..... *B31D 5/0043* (2013.01); *B26D 1/0006* (2013.01); *B26D 1/08* (2013.01);
(Continued)

(58) Field of Classification Search
CPC ..... B31D 5/0043; B31D 2205/0058; B31D 2205/0082; B31D 2205/0094;
(Continued)

(56) References Cited

U.S. PATENT DOCUMENTS 2,654,429 A * 10/1953 Rupp ..... B26D 7/02 83/380
4,094,217 A * 6/1978 Exline ..... B26D 1/035 83/368
(Continued)

FOREIGN PATENT DOCUMENTS

DE 202006012879 U1 12/2006
DE 202012100166 U1 4/2013
EP 2343166 A1 7/2011

OTHER PUBLICATIONS

The International Search Report and the Written Opinion of the International Searching Authority for Corresponding International Application PCT/US2017/026309 dated Aug. 8, 2017.

*Primary Examiner* — Dariush Seif
(74) *Attorney, Agent, or Firm* — Renner, Otto, Boisselle & Sklar, LLP

(57) ABSTRACT

A cutting mechanism is provided for a dunnage conversion machine 10 that selectively cuts dunnage sheet stock drawable through the cutting mechanism. The cutting mechanism includes a frame and a pair of opposed cutting blades through which the sheet stock is drawable. The cutting blades include a driven blade and a biased blade, each supported relative to the frame for movement into and out of contact with one another. The driven blade is movable towards the biased blade to cut the sheet stock. The biased blade is biased against movement away from the driven blade to allow for self-adjustability to counter wear of one
(Continued)

or both of the opposed blades. Contact of the opposed blades with one another causes the biased blade to be deflected away from the driven blade.

14 Claims, 14 Drawing Sheets

(51) Int. Cl.
*B26D 7/26* (2006.01)
*B26D 1/08* (2006.01)
*B26D 1/00* (2006.01)

(52) U.S. Cl.
CPC ..... *B26D 1/085* (2013.01); *B26D 7/22* (2013.01); *B26D 7/2614* (2013.01); *B31D 5/0039* (2013.01); *B26D 2001/0066* (2013.01); *B31D 2205/0058* (2013.01); *B31D 2205/0082* (2013.01); *B31D 2205/0094* (2013.01)

(58) Field of Classification Search
CPC ..... B31D 5/0039; B31D 5/00; B26D 1/0006; B26D 1/08; B26D 1/085; B26D 7/22; B26D 7/2614; B26D 7/26; B26D 2001/0066
USPC ..... 493/340, 372; 83/382, 563, 582, 583; 30/173, 182
See application file for complete search history.

(56) References Cited

U.S. PATENT DOCUMENTS 4,936,177 A * 6/1990 Ozawa ..... B26D 1/085 83/582
5,105,703 A * 4/1992 Kondo ..... B26D 1/0006 83/582
5,569,146 A * 10/1996 Simmons ..... B26D 1/08 493/352
6,155,152 A * 12/2000 Bilstein ..... B26D 1/245 83/397
7,503,247 B2 * 3/2009 Cavanagh ..... B26D 1/035 83/563
7,819,599 B2 * 10/2010 Kobayashi ..... B41J 11/003 400/621
8,562,229 B2 * 10/2013 Inaba ..... B26D 1/0006 400/621
8,662,771 B2 * 3/2014 Kawaguchi ..... B26D 1/085 400/621
9,393,817 B2 * 7/2016 Murata ..... B41J 11/70
2001/0042431 A1 * 11/2001 Epskamp ..... B23D 15/00 83/694
2004/0057771 A1 * 3/2004 Yamada ..... B26D 7/2614 400/621
2005/0036820 A1 * 2/2005 Watanabe ..... B26D 1/085 400/621
2007/0175307 A1 * 8/2007 Ito ..... B26D 1/0006 83/583
2007/0199422 A1 * 8/2007 Kawaguchi ..... B26D 7/0006 83/583
2008/0207421 A1 * 8/2008 Wetsch ..... B65H 35/008 493/464
2009/0165625 A1 * 7/2009 Ishii ..... B26D 7/025 83/613
2009/0178529 A1 * 7/2009 Kozryski ..... B23D 35/001 83/488
2009/0279935 A1 * 11/2009 Kawaguchi ..... B26D 7/2628 400/621
2010/0221055 A1 * 9/2010 Shirotori ..... B26D 1/305 400/621
2010/0221056 A1 * 9/2010 Shirotori ..... B26D 1/085 400/621
2011/0008091 A1 * 1/2011 Tsukada ..... B26D 1/085 400/621
2011/0158731 A1 * 6/2011 Suzuki ..... B26D 1/085 400/621
2011/0170931 A1 * 7/2011 Kawaguchi ..... B26D 7/24 400/621
2011/0281711 A1 * 11/2011 Chan ..... B31D 5/0043 493/464
2012/0027496 A1 * 2/2012 Mochida ..... B26D 1/0006 400/621
2012/0057918 A1 * 3/2012 Eoka ..... B41J 11/70 400/621
2013/0104718 A1 * 5/2013 Tai ..... B26D 1/085 83/582
2013/0205958 A1 * 8/2013 Janszen ..... B26D 1/085 83/13
2013/0255457 A1 * 10/2013 Yazawa ..... B26D 1/0006 83/55
2013/0272769 A1 * 10/2013 Yazawa ..... B26D 7/2614 400/621
2013/0276609 A1 * 10/2013 Hatakeyama ..... B26D 7/08 83/582
2015/0183123 A1 * 7/2015 Niichel ..... B23D 59/00 83/418
2015/0209973 A1 * 7/2015 Hauser ..... B26D 7/2628 83/856
2016/0221202 A1 * 8/2016 Powers, II ..... B26D 1/0006

* cited by examiner

CUTTING MECHANISM FOR A DUNNAGE CONVERSION MACHINE AND METHOD

RELATED APPLICATIONS

This application is a national phase of International Application No. PCT/US2017/026309, filed Apr. 6, 2017, and published in the English language, and which claims priority to U.S. Application No. 62/329,291 filed Apr. 29, 2016, both which are each hereby incorporated herein by reference in their entireties.

FIELD OF THE INVENTION

This invention relates generally to dunnage conversion machines that convert a sheet stock material into a relatively less dense dunnage product and more particularly to a cutting mechanism for use with such a dunnage conversion machine.

BACKGROUND

In the process of shipping one or more articles from one location to another, a packer typically places some type of dunnage material in a shipping container, such as a cardboard box, along with the article or articles to be shipped. The dunnage material typically is used to wrap the articles, or to partially or completely fill the empty space or void volume around the articles in the container. By filling the void volume, the dunnage restricts or prevents movement of the articles that might lead to damage during the shipment process. The dunnage also can perform blocking, bracing, or cushioning functions.

Some commonly used dunnage materials are plastic foam peanuts, plastic bubble pack, air bags, and converted paper dunnage material. Unlike most plastic dunnage products, converted paper dunnage material is an ecologically-friendly packing material that is recyclable, biodegradable, and composed of a renewable resource. The stock material is typically provided in sheet form in a bulk supply, such as on a roll or in a fan-folded stack. To produce discrete dunnage products, the conversion process requires a separation step where discrete lengths are separated from the stock material before, after, or during conversion.

SUMMARY

The present invention provides an improved dunnage cutting mechanism for use with a dunnage conversion machine. The cutting mechanism is compact, easy to use, and uses a pair of opposed cutting blades to produce a discrete length of dunnage product from sheet stock. The opposed cutting blades are brought into contact with one another during a cutting operation of the cutting mechanism to sever or to cut a discrete length of sheet stock from the substantially continuous bulk supply of sheet stock material. At least one of the opposed blades is self-adjustable relative to the other of the opposed blades to account for wear of one or both of the opposed blades over repeated use. The cutting mechanism also includes a blade guard that is commonly movable with one of the opposed blades to restrict movement of the one of the opposed blades independent from the blade guard during the cutting operation.

More particularly, according to a first aspect of the invention, there is a cutting mechanism for a dunnage conversion machine that selectively cuts dunnage sheet stock drawable through the cutting mechanism. The cutting mechanism includes a frame, and a driven blade supported relative to the frame for movement towards a biased blade and across a sheet stock path along which the sheet stock is movable through the cutting mechanism, to cut the sheet stock into discrete lengths. The cutting mechanism also includes the biased blade supported relative to the frame for movement towards and away from the driven blade. The biased blade is biased against movement away from the driven blade.

According to a second aspect of the invention, there is another cutting mechanism for a dunnage conversion machine that selectively cuts dunnage sheet stock drawable through the cutting mechanism. The cutting mechanism includes a frame supporting opposed blades for cutting the sheet stock, and the opposed blades. The opposed blades include a driven blade having a driven cutting edge and a biased blade having a biased cutting edge movable relative to one another. The driven cutting edge is movable between a ready position and a cut position removed from the ready position and in contact with the biased cutting edge. The biased blade is biased toward the driven blade. Contact of the blades with one another occurs at a shear point that traverses an edge length of the biased cutting edge as the driven cutting edge moves between the ready position and the cut position to cut the sheet stock.

Embodiments of the invention may have one or more of the following features:

- The biased cutting edge may be biased across a movement path of the driven cutting edge when the driven cutting edge is in the ready position.
- Contact of the driven blade with the biased blade may effect movement of the biased blade against a biasing force in a direction of movement away from the driven blade.
- Contact of the driven cutting edge with the biased cutting edge may effect movement of the biased cutting edge out of a movement path of the driven cutting edge.
- The driven blade and driven cutting edge may be linearly translatable towards the biased cutting edge.
- The biased cutting edge may be pivotably biased towards the driven cutting edge.
- The cutting mechanism may further include a blade guard coupled between the frame and the driven blade, the blade guard arranged to project beyond the driven cutting edge to restrict movement of the driven cutting edge beyond an outer periphery of the blade guard until the driven cutting edge is within a predetermined distance from the biased cutting edge.
- The predetermined distance may be less than about 5 mm.
- The cutting mechanism may further include a blade guard coupled between the frame and the driven blade, the blade guard configured to be commonly movable with the driven blade between an engaged position of the blade guard and a disengaged position of the blade guard, and the blade guard configured to restrict cutting of the sheet stock and movement of the driven blade separate from the blade guard until the blade guard is moved to the disengaged position.
- Each of the driven cutting edge and the biased cutting edge may be linear edges.
- A dunnage conversion machine may include a conversion assembly that converts dunnage sheet stock into a relatively less-dense dunnage product, and the cutting mechanism for cutting the sheet stock.

According to a third aspect of the invention, there is a cutting mechanism for a dunnage conversion machine that selectively cuts dunnage sheet stock drawable through the cutting mechanism. The cutting mechanism includes a frame, a driven blade and a secondary blade each supported relative to the frame and defining a path therebetween along which the sheet stock to be cut may be passed. The driven blade is supported relative to the frame for linear translation towards the secondary blade to cut the sheet stock. The cutting mechanism also includes a blade guard coupled between the frame and the driven blade. The blade guard is configured to be commonly movable with the driven blade between an engaged position of the blade guard and a disengaged position of the blade guard. The blade guard is configured to restrict cutting of the sheet stock and independent movement of the driven blade separate from the blade guard until the blade guard is moved to the disengaged position.

The blade guard may be configured to shift in a direction transverse a direction of common movement with the driven blade, once the blade guard is moved to the disengaged position.

The secondary blade may be resiliently biased towards the driven blade, the secondary blade being movable away from the driven blade in response to contact with the driven blade.

The cutting mechanism may include a slot and key arrangement for guiding movement of the blade guard and the driven blade relative to one another. One of the blade guard and the driven blade may include the key of the arrangement, and the other of the blade guard and the driven blade may include the slot of the arrangement. The slot may be shaped to maintain common movement of the blade guard and the driven blade until the blade guard is in the disengaged position, and thereafter to allow movement of the driven blade independent from the blade guard.

The slot and key arrangement may include two slots and two corresponding keys. The two slots may include an S-shaped slot guiding independent movement of the blade guard relative to the frame and an L-shaped slot guiding both common movement of the blade guard with the driven blade and independent movement of the blade guard separate from the driven blade.

According to a fourth aspect of the invention, there is a cutting mechanism for a dunnage conversion machine that selectively cuts dunnage sheet stock drawable through the cutting mechanism. The cutting mechanism includes a frame, a driven blade and a secondary blade each supported relative to the frame. The driven blade is supported relative to the frame for linear translation towards the secondary blade to cut the sheet stock drawable between the driven blade and the secondary blade. The cutting mechanism also includes a blade guard coupled between the frame and the driven blade. The blade guard is configured to project beyond a driven cutting edge of the driven blade to restrict movement of the driven cutting edge beyond an outer periphery of the blade guard until the driven cutting edge is within a predetermined distance from a secondary cutting edge of the secondary blade with which the driven cutting edge is engageable.

The blade guard may be configured to shift in a direction transverse a direction of translation of the driven blade when the driven cutting edge is within the predetermined distance from the secondary cutting edge.

The cutting mechanism may include a slot and key arrangement for guiding movement of the blade guard and the driven blade relative to one another. One of the blade guard and the driven blade may include the key of the arrangement and the other of the blade guard and the driven blade may include the slot of the arrangement. The slot may be shaped to maintain common movement of the blade guard and the driven blade until the driven cutting edge is within the predetermined distance from the biased cutting edge, and thereafter to allow independent movement of the driven blade separate from the blade guard.

The slot and key arrangement may include two slots and two corresponding keys, the two slots including an S-shaped slot guiding independent movement of the blade guard relative to the frame and an L-shaped slot guiding both common movement of the blade guard with the driven blade and independent movement of the blade guard separate from the driven blade.

The predetermined distance may be less than about 5 mm.

According to a fifth aspect of the invention, there is a cutting mechanism for a dunnage conversion machine that selectively cuts dunnage sheet stock drawable through the cutting mechanism. The cutting mechanism includes a frame, a driven cutting means supported relative to the frame, and a self-adjustable cutting means also supported relative to the frame. The self-adjustable cutting means is arranged to self-adjust its position relative to the driven cutting means to account for wear of at least one of the driven cutting means and the self-adjustable cutting means. The driven cutting means and the self-adjustable cutting means are engageable with one another to cut the sheet stock drawable between the driven cutting means and the self-adjustable cutting means. The cutting mechanism also includes a guarding means arranged to project beyond a driven cutting edge of the driven cutting means to restrict movement of the driven cutting edge beyond an outer periphery of the guarding means until the driven cutting edge is within a predetermined distance from a cutting edge of the self-adjustable cutting means.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

Generally, the present invention provides a dunnage conversion machine and method for converting a generally planar, two-dimensional dunnage sheet stock into a relatively increased volume, lower density, three-dimensional dunnage product of a discrete length. Particularly, the dunnage conversion machine is capable of making, and the method provides for making, converted dunnage products having a three-dimensional shape and increased volume per unit of length as compared to the original unexpanded sheet stock. The dunnage products are formed from at least one ply of sheet stock being generally planar and two-dimensional.

Figure 1:
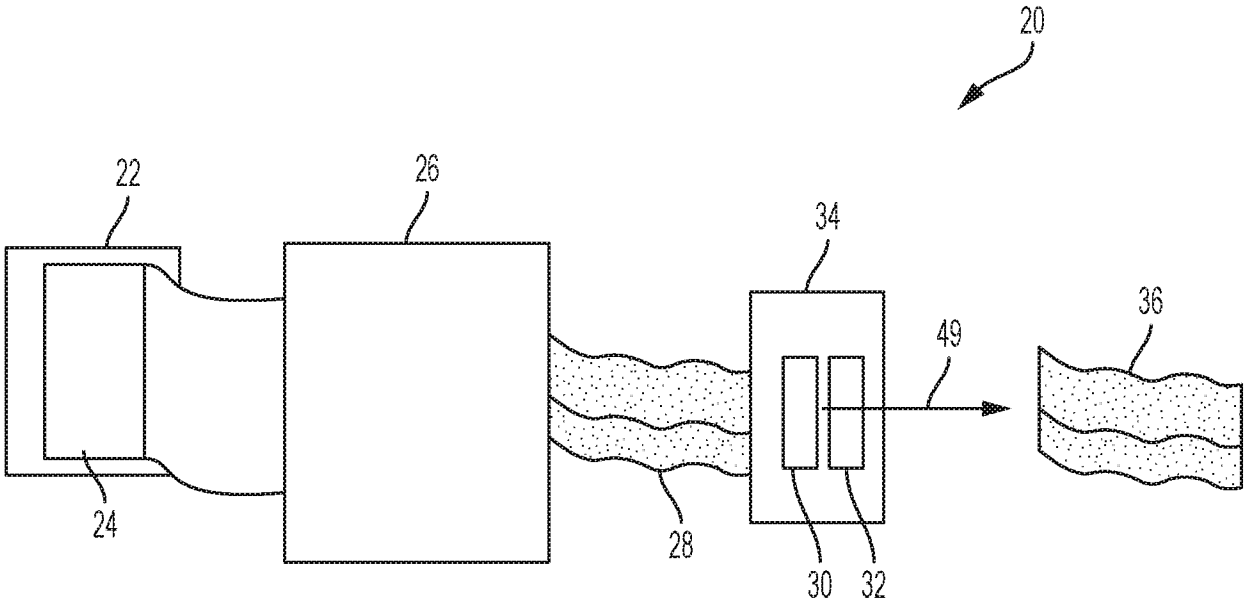
FIG. 1 is a schematic illustration of a dunnage conversion machine including a cutting mechanism in accordance with the present invention.
Figure 2:
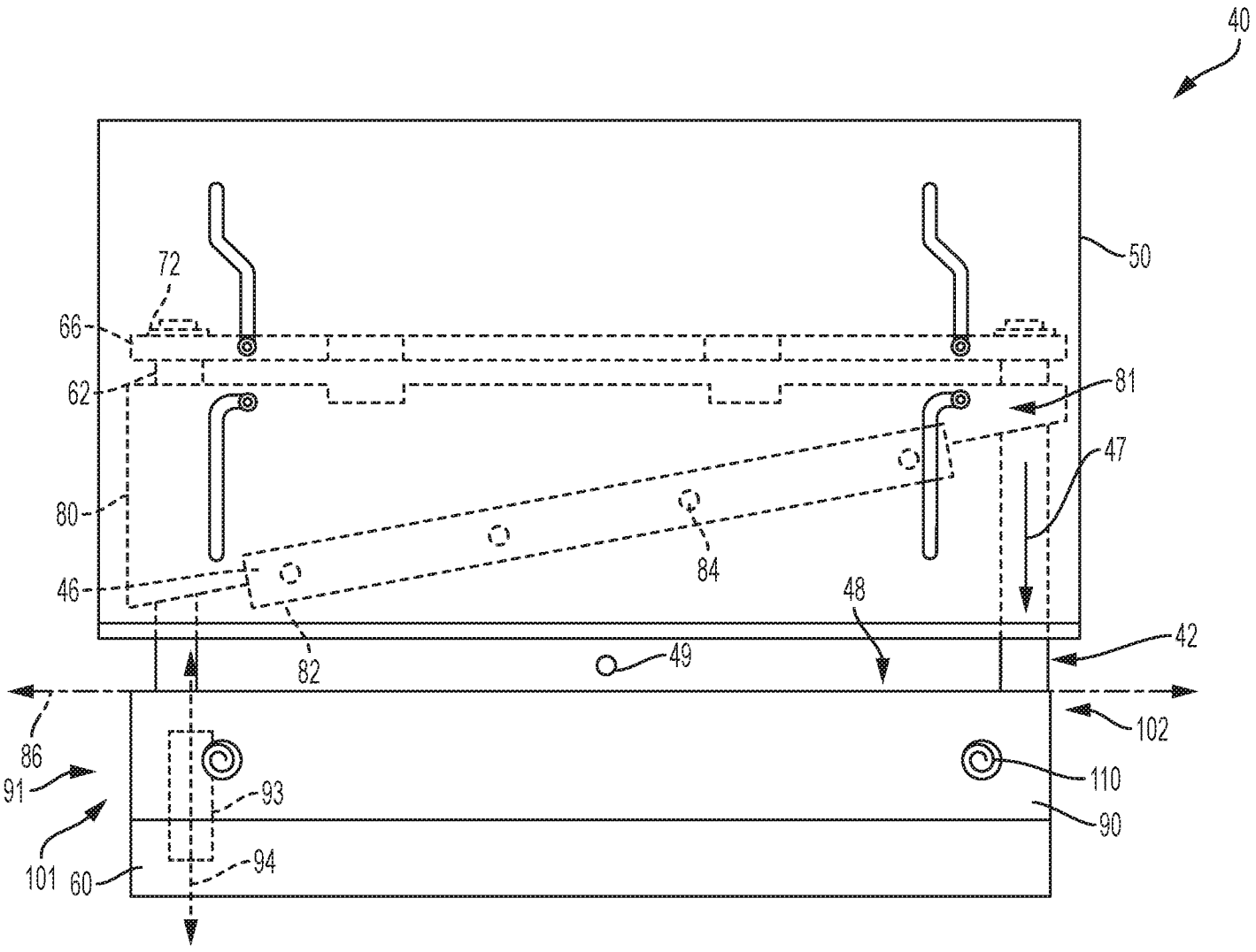
FIG. 2 is a front view of an exemplary cutting mechanism for use with the dunnage conversion machine of FIG. 1, where a blade guard is shown as transparent to allow other components to be visible.
Figure 3:
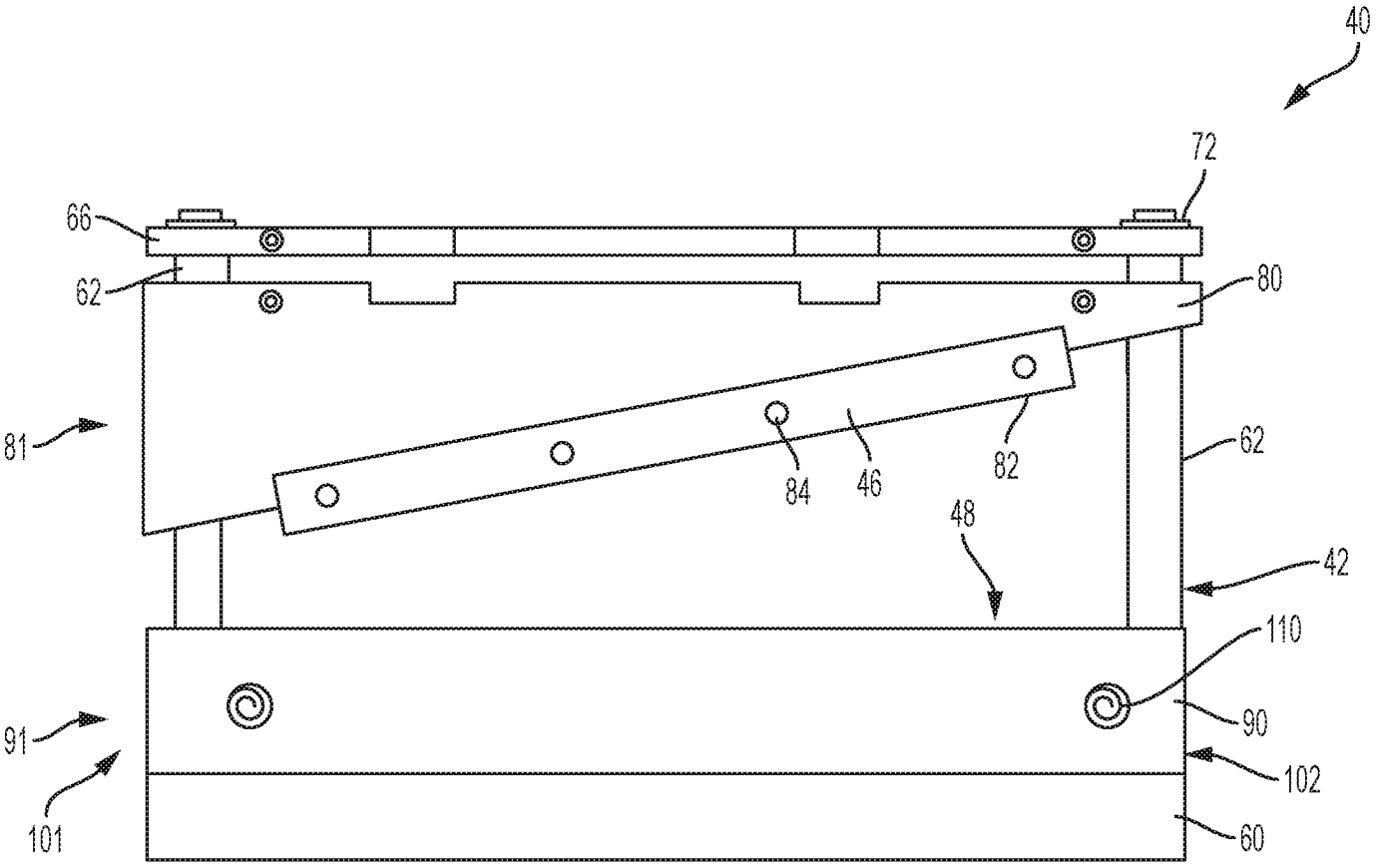
FIG. 3 is a front view of the cutting mechanism of FIG. 2, with the blade guard removed.
Figure 4:
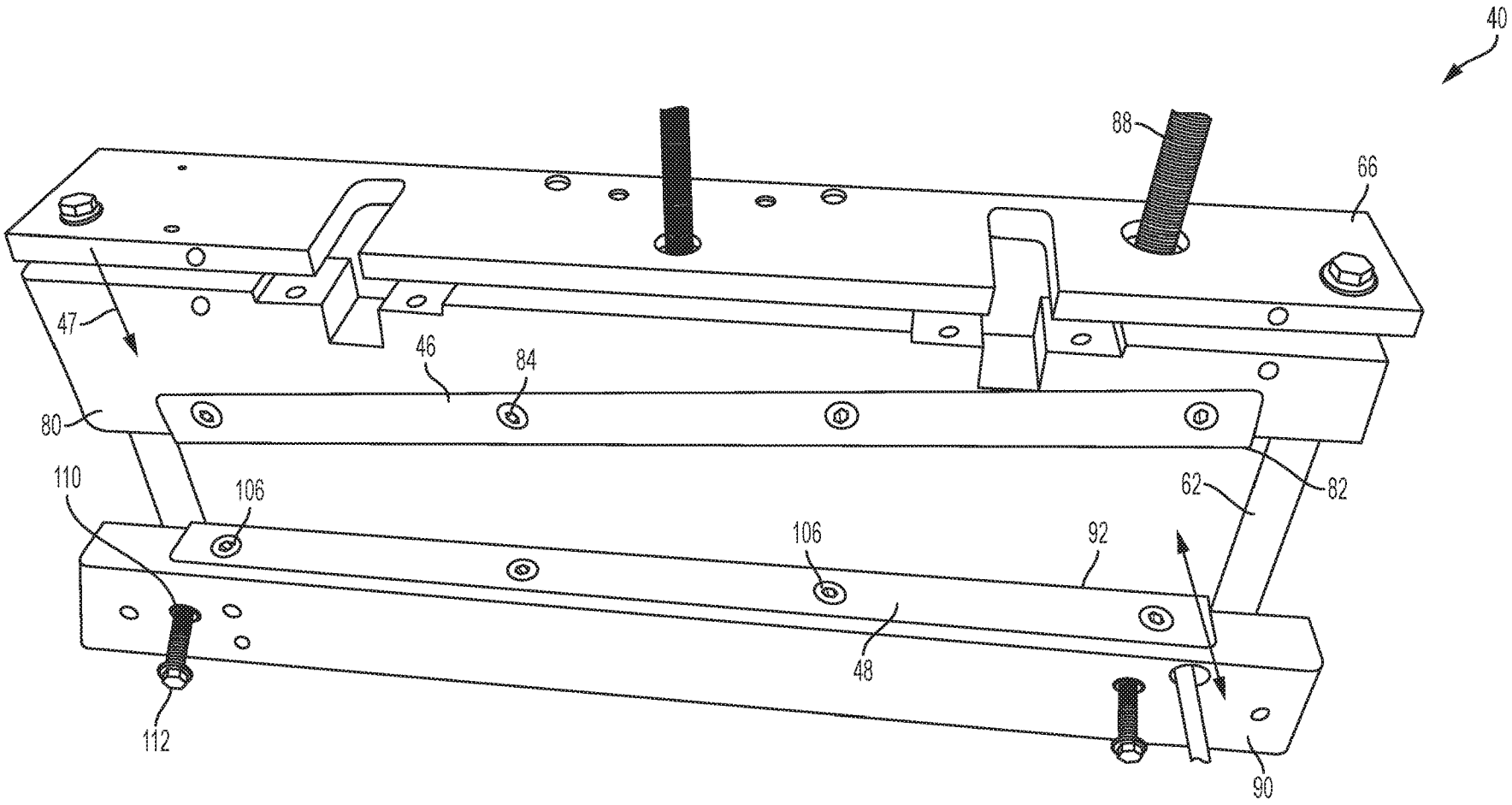
FIG. 4 is a front perspective view of the cutting mechanism of FIG. 2.
Figure 5:
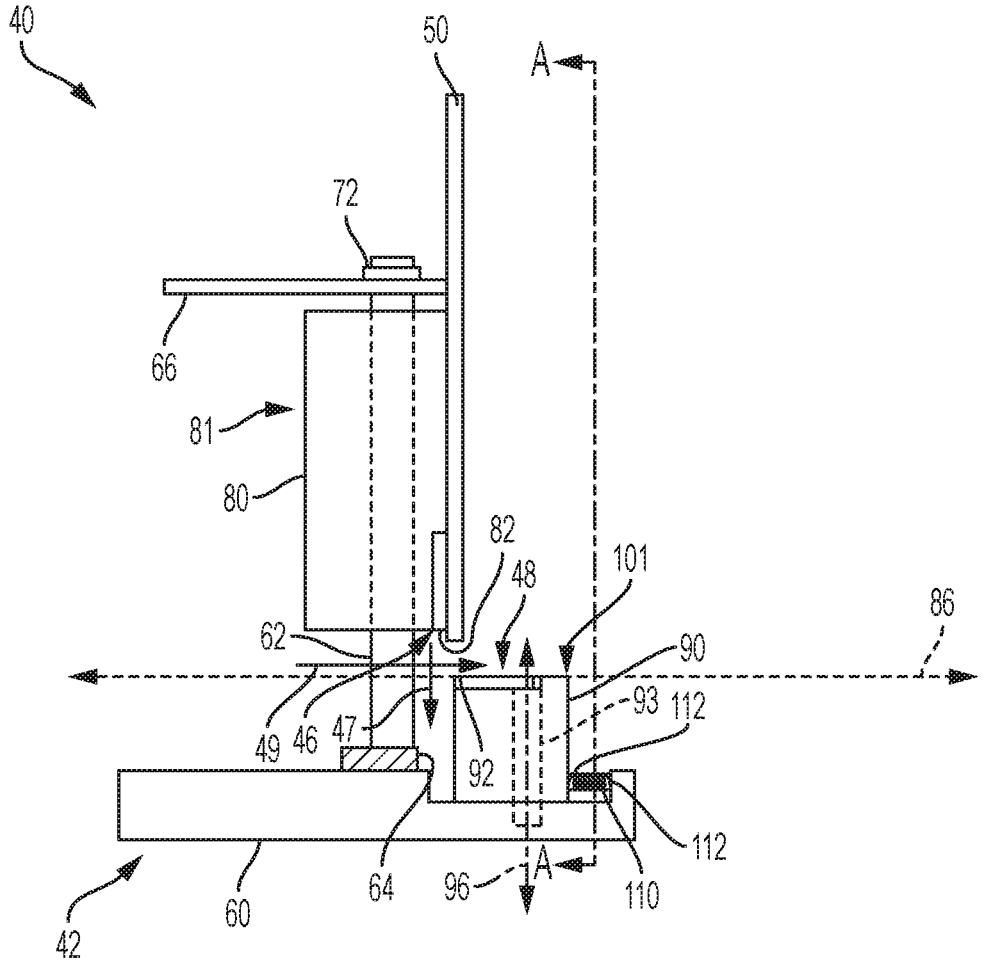
FIG. 5 is side view of the cutting mechanism of FIG. 2.

Referring now to the drawings, and initially to FIG. 1, an exemplary dunnage conversion machine 20 is shown schematically and includes a stock supply assembly 22, also herein referred to as a supply assembly 22, having a bulk supply of dunnage sheet stock 24. The sheet stock 24 drawn from the bulk supply is also herein referred to as sheet stock material 24.

The bulk supply may be arranged on a stand, a cart, or simply supported adjacent the conversion machine 20. The sheet stock 24 of the bulk supply may be of a substantially continuous length, and may be provided either in roll form or as a series of connected, generally rectangular pages in a fan-folded stack. The rolls or stacks can be spliced to successive supplies so as to appear as a never-ending supply to the conversion machine 20.

Multiple rolls or stacks may be used to provide the multiple sheets or webs of stock material for conversion into the three-dimensional dunnage product. Alternatively, a single roll may include multiple plies co-wrapped into the single roll or a single stack may include multiple plies co-folded into the single stack.

Suitable supplies of sheet stock include paper, plastic sheets, or sheets of a combination thereof. The sheet stock also may be laminated or may include a combination of laminated and non-laminated sheet material. An exemplary sheet stock 24 for use with the conversion machine 20 includes either a single-ply or multi-ply kraft paper. Suitable kraft paper may have various basis weights, such as twenty-pound or forty-pound, for example, and respective plies may have different basis weights. One exemplary sheet stock 24 may be a single-ply kraft paper that is recyclable, biodegradable, and composed of a renewable resource.

A conversion assembly 26 for receiving the dunnage sheet stock 24 from the bulk supply is located downstream of the stock supply assembly 22 and converts the sheet stock 24 into a converted sheet stock, such as a relatively less dense strip of dunnage 28. The downstream direction is a direction of advancement of stock material through the dunnage conversion machine 20. An upstream direction is the direction opposite the downstream direction of advancement.

An exemplary conversion assembly 26 may be configured to randomly crumple the sheet stock 24 received therein. For example, the sheet stock material 24 may be laterally crumpled across a width of the sheet stock material 24 as it is drawn along its longitudinal length in the downstream direction through the dunnage conversion machine 20. In this way, the sheet stock 24 may be converted into a three-dimensional strip of dunnage 28 having increased volume as compared to the sheet stock 24 of the bulk supply.

The converted strip of dunnage 28 is drawn through the conversion machine 20, in a downstream direction into and through a cutting mechanism 34. Particularly, the substantially continuous strip of dunnage 28 is drawn between opposed blades 30 and 32 of the cutting mechanism 34 for cutting the strip of dunnage 28 into dunnage products 36 of discrete length. The cutting mechanism 34 is located downstream of the conversion assembly 26.

While the stock supply assembly 22, the conversion assembly 26, and the cutting mechanism 34 are illustrated as separated elements of the conversion machine 20 in FIG. 1, one or more of the stock supply assembly 22, the conversion assembly 26, and the cutting mechanism 34 may be coupled to, integral with, or separate from one another in other embodiments.

While the cutting mechanism 34 is shown downstream of the stock supply assembly 22 and the conversion assembly 26, the cutting mechanism 34 may be otherwise positioned. For example, the cutting mechanism 34 may be positioned downstream of the stock supply assembly 22 and upstream of the conversion assembly 26, to cut the unconverted sheet stock 24. In another example, the cutting mechanism 34 may be located within the conversion assembly 26 such as to cut the sheet stock material during conversion.

As used herein, the term sheet stock refers to material drawn from the bulk supply. The term sheet stock may refer to material that is converted, fully or partially, or to non-converted material. Generally, the cutting mechanism 34 is provided for cutting the sheet stock, and the state of the sheet stock being cut depends on the location of the cutting mechanism 34 relative to the conversion assembly 26.

Turning now to FIGS. 2-5, a cutting mechanism 40 is shown for use with a dunnage conversion machine, such as with the dunnage conversion machine 20 of FIG. 1. The cutting mechanism 40 includes a frame 42 and a set of opposed cutting blades 44. The opposed cutting blades 44 include a primary blade 46 and a secondary blade 48. A blade guard 50 is provided to restrict completion of a cutting operation of the cutting mechanism 40 under predetermined conditions, as will be described herein.

The depicted frame 42 includes a base 60 fixed to a stationary surface, such as a frame of the conversion machine, for example. The frame 42 may be secured in place by way of fasteners or other means. The frame 42 is configured, such as via guiding members 62, for guiding one or more of the primary blade 46 and the secondary blade 48 as they move relative to one another.

At least one guiding member 62, and as illustrated two opposed guiding members 62, extend upwardly from the base 60. The guiding members 62 guide movement of at least one of the blades of the set of opposed cutting blades 44. In the depicted embodiment, the guiding members 62 guide the primary blade 46 toward the secondary blade 48 and toward a path of the sheet material between the primary blade 46 and the secondary blade 48.

The guiding members 62 are coupled to the base 60, such as by fasteners 64, for example nuts and bolts. Other coupling means may be suitable, or one or more of the guiding members 62 may be integral with the base 60. The depicted guiding members 62 are cylindrical rods, though other suitable shapes may be used in other embodiments. Any suitable number of guiding members, one or more, may be used.

Additionally, terms of direction, such as upwardly, are relative terms, and components of the cutting mechanism 40 may be differently oriented in other embodiments. Coupling may refer to direct coupling of two components together or indirect coupling using an intermediary component to couple two components together.

A stop member 66 is fixed to a distal end 66 of the guiding members 62, opposite a proximal end 68 of the guiding members 62 coupled to the base 60. The stop member 66 limits upward movement of the primary blade 46 in a direction away from the secondary blade 48. Fasteners 72, such as nuts and bolts, may be used to couple the stop member 66 to the guiding members 62. While the illustrated stop member 66 is shown as a plate receiving the guiding members 62 through openings in the stop member 66, other constructions may be suitable. For example, one or more of the stop member 66, the guiding members 62, and the base 60 may be integral with one another.

While the frame 42 is shown including a particular construction in the depicted embodiment of FIGS. 2-5, it will be understood that other constructions may be suitable. Generally, the frame 42 is configured to support each of the primary blade 46 and the secondary blade 48 for movement relative to one another and relative to a path of the sheet material between the opposed cutting blades 44. Numerous other constructions providing adequate support and guidance for the blades 44 are conceivable.

Turning now to details of the opposed cutting blades 44, a driven assembly 81 includes the primary blade 46, which is a driven blade 46 that is supported relative to the frame 42, for movement towards the secondary blade 48, via a driven carriage 80 of the driven assembly 81. The driven carriage 80 is received on the guiding members 62 and may be of any suitable shape. The driven blade 46 is attached to the driven carriage 80, such as via suitable fasteners 84. While the illustrated embodiment shows the guiding members 62 extending through respective cavities in the driven carriage 80, the driven carriage 80 may be otherwise slidably coupled to the guiding members 62 in other embodiments.

The driven blade 46 is supported for being driven across a path of the sheet stock between the driven blade 46 and the secondary blade 48, which may be herein referred to as a sheet stock path 49. In this way, the sheet stock, such as a converted strip of dunnage output from a conversion assembly is separated into discrete lengths.

The driven blade 46 is supported by the guiding members 62 for movement towards the secondary blade 48, such as linear translation towards the secondary blade 48 and towards the strip path 49. For example, the driven blade 46 acts as a guillotine with respect to the respective sheet material drawn through the cutting mechanism 40. While the driven blade 46 is shown and described as being linearly translatable, the driven blade 46 could be pivotably moved into engagement/or contact with the secondary blade 48 in other embodiments.

The driven blade 46 may be driven manually, such as via an operator applying force to a lever (not shown), for example attached to the driven carriage 80. Alternatively, the driven blade 46 may be linearly translated by other suitable means, such as a linear actuator, pneumatics, hydraulics, etc. For example, an actuation pedal may be pressed by an operator's foot, causing an electromechanical linear actuator to move the driven blade 46 towards the secondary blade 48.

In some embodiments, the driven blade 46 may be resiliently biased, such as linearly resiliently biased away from the secondary blade 48. For example, a biasing element 88 (FIG. 4), such as a spring, may be coupled between the driven carriage 80 and one of the guiding elements 62 to enable automatic return of the driven blade 46 to its default position. One or more biasing elements 88 may be included, and in some embodiments, the biasing element 88 may be omitted.

The driven blade 46 has a leading driven cutting edge 82 for being driven along the driven path 47 to engage a respective cutting edge of the secondary blade 48, to cut the sheet material. The driven cutting edge 82 may be a linear edge, as shown. In other embodiments, the driven cutting edge 82 may be differently shaped.

The driven cutting edge 82 is aligned at an angle that is other than orthogonal to the longitudinal direction of translation of the driven blade 46 along the guiding members 62. The driven cutting edge 82 is also disposed at a fixed angle relative to the secondary blade 48, and relative to a plane of movement of the respective cutting edge of the secondary blade 48.

A biased assembly 91 includes the secondary blade 48, which is a biased blade 48 that is supported relative to the frame 42, for movement into and through a movement path of the driven blade 46, via a biased carriage 90 of the biased assembly 91. The biased blade 48 is attached to the biased carriage 90, such as via suitable fasteners 106.

The biased carriage 90 is coupled, such as pivotably coupled, to the frame 42, and may be of any suitable shape. In the illustrated embodiment, a suitable fastener 93, such as a pin, extends between the biased carriage 90 and the base 60 of the frame 42, defining a pivot axis 96 of the biased blade 48. The pivot axis 96 is disposed near a lateral end 100 of the biased blade 48, opposite a lateral end 102, and outside of a path 49 of the sheet stock material between the opposed blades 44.

In other embodiments, a different fastener or a slot a key arrangement, for example, may allow for pivotable coupling of the biased blade 48 relative to the frame 42. In some embodiments, the pivot axis 96 may be disposed intermediately between opposed lateral ends 100 and 102 of the biased blade 48, rather than near the lateral end 100. In some embodiments, the pivot axis may be a moving pivot axis, such as a translating pivot axis.

Through movement about the pivot axis 96, the biased blade 48 is resiliently biased towards the driven blade 46 and against movement away from the driven blade 46. The biased blade 48 is resiliently biased via at least one biasing member 110 towards, and preferably across, a movement path of the driven blade 46, which maybe herein referred to as a driven path 47. As shown, two biasing members 110 resiliently urge the biased blade 48 towards the driven path 47. The biasing members 110, such as springs, are supported at least partially by the base 60, and may be coupled to the base 60 or to the biased carriage 90 via suitable fasteners 112.

The biased blade 48 has a leading biased cutting edge 92 for engaging the driven cutting edge 82 of the driven blade 46. The biased cutting edge 92 is a linear edge, though may be differently shaped in other embodiments. The biased cutting edge 92 is generally movable in a direction transverse a direction of translation of the driven cutting edge 82 of the driven blade 46.

Figure 6:
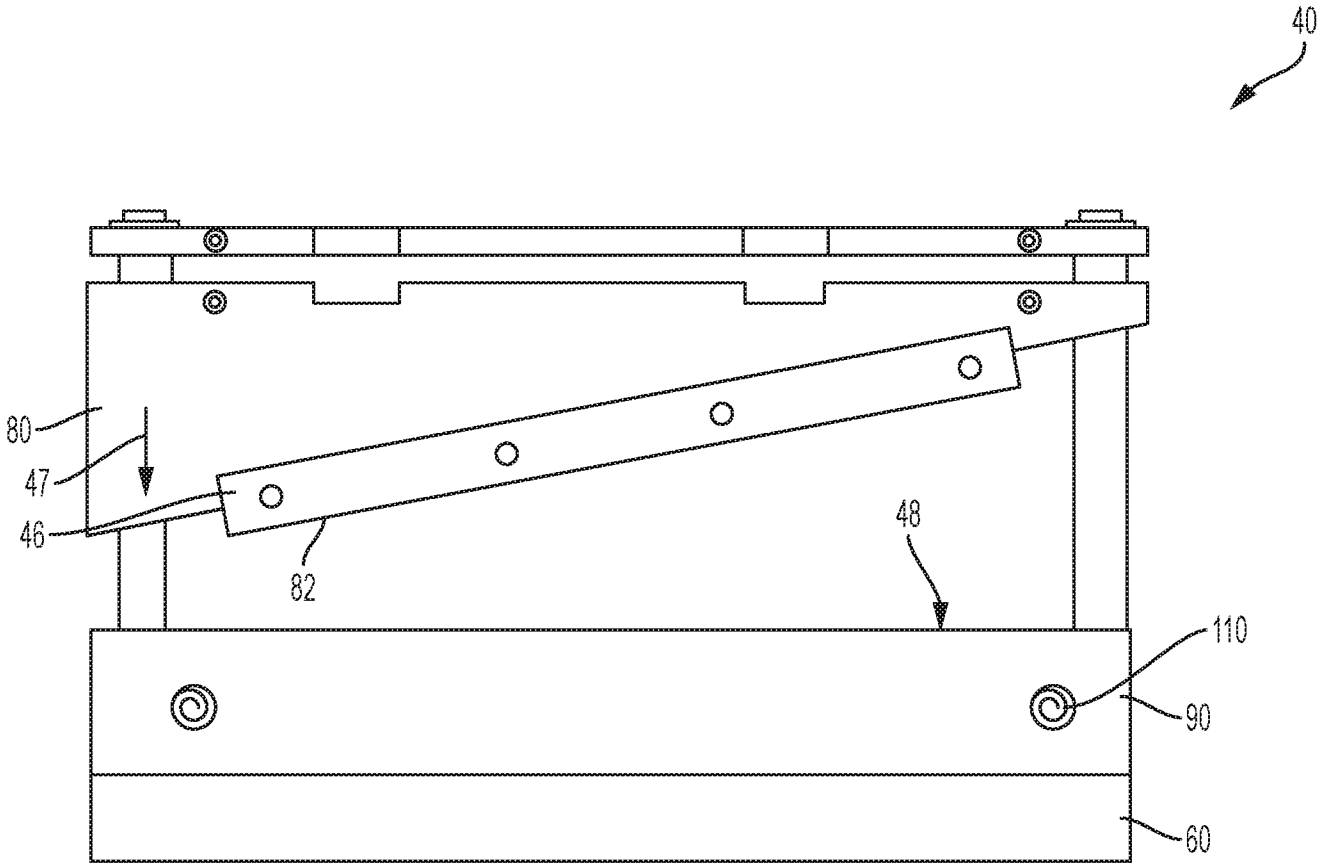
FIG. 6 is a front view of the cutting mechanism of FIG. 2, shown through line A-A of FIG. 5, with the blade guard removed and a primary blade in a ready position.
Figure 7:
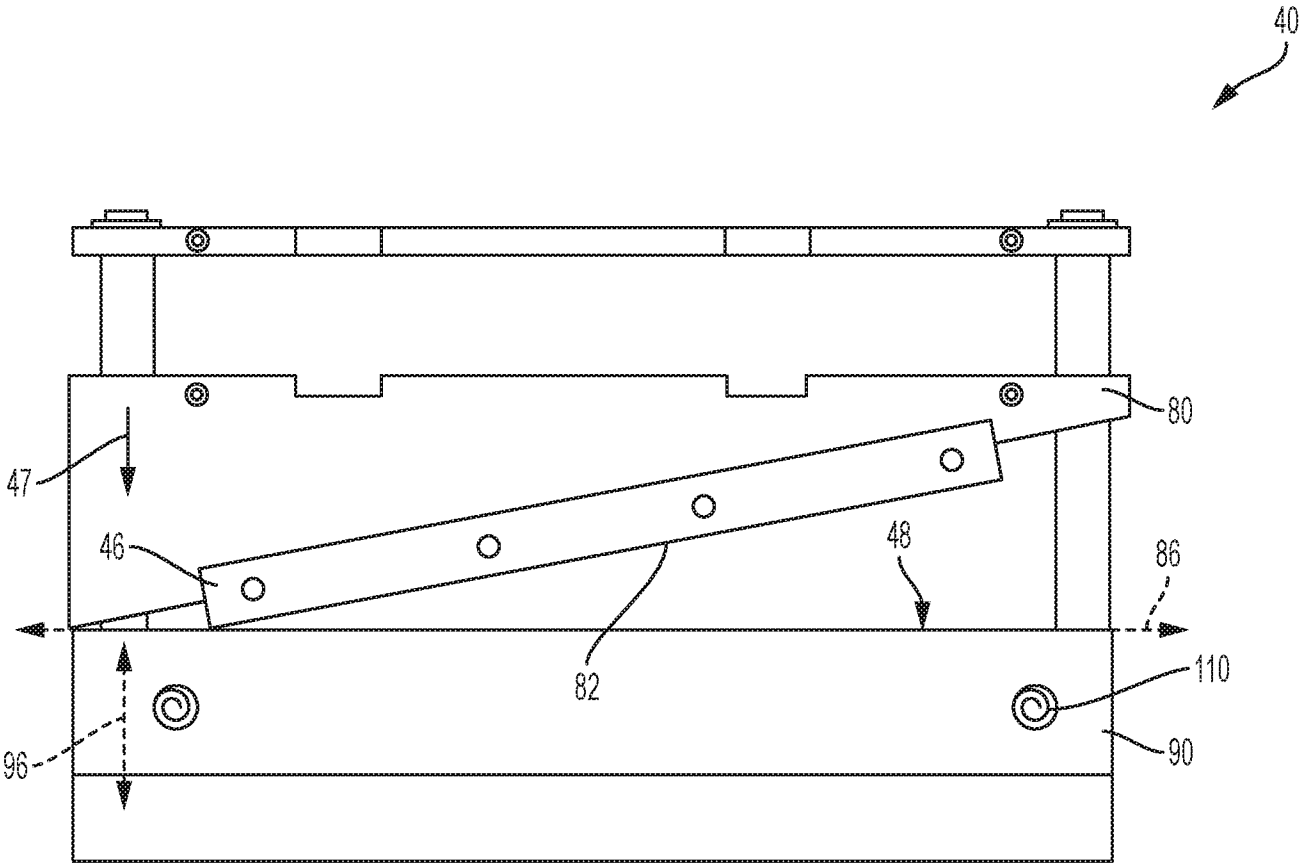
FIG. 7 is a front view of the cutting mechanism of FIG. 2, shown through line A-A of FIG. 5, with the blade guard removed and the primary blade in an intermediate position.
Figure 8:
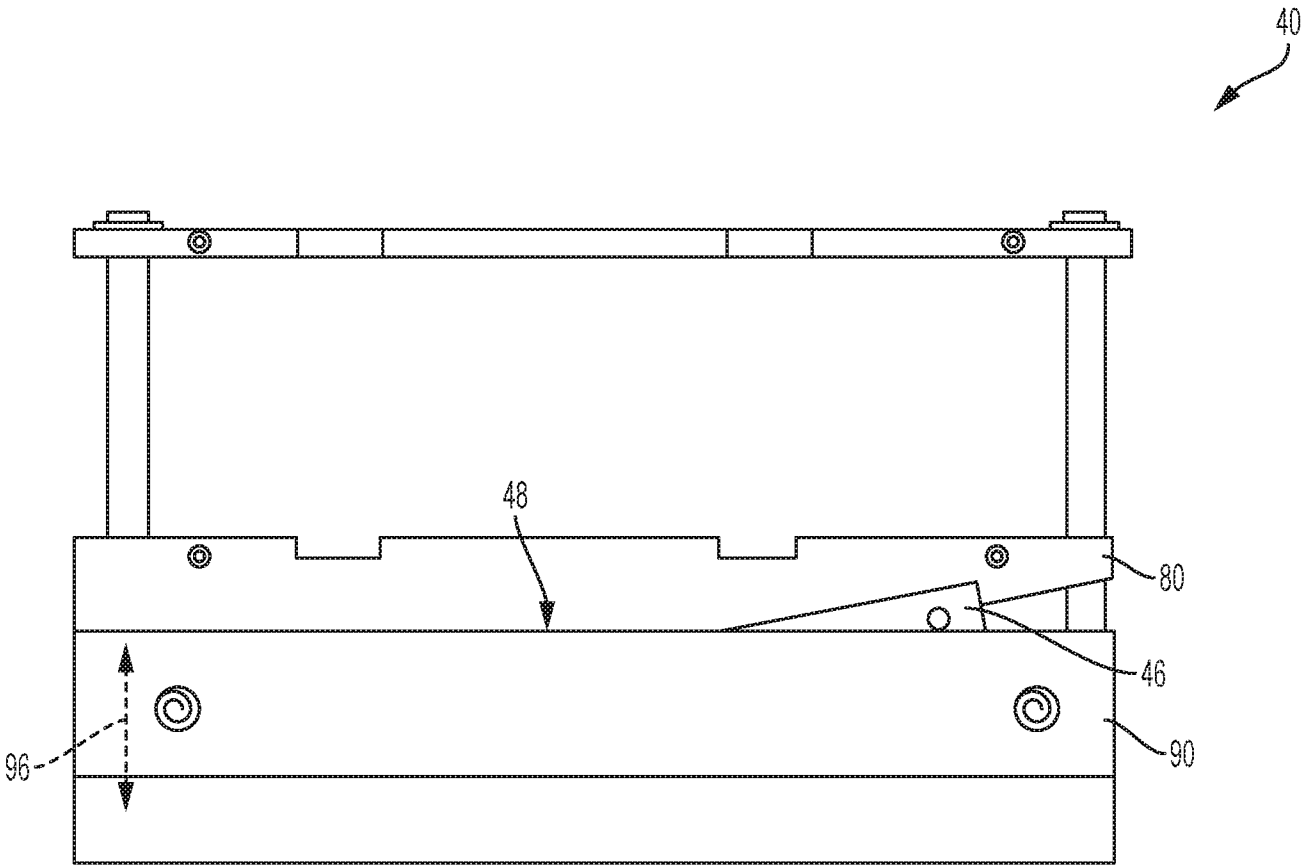
FIG. 8 is a front view of the cutting mechanism of FIG. 2, shown through line A-A of FIG. 5, with the blade guard removed and the primary blade in a cut position.
Figure 11:
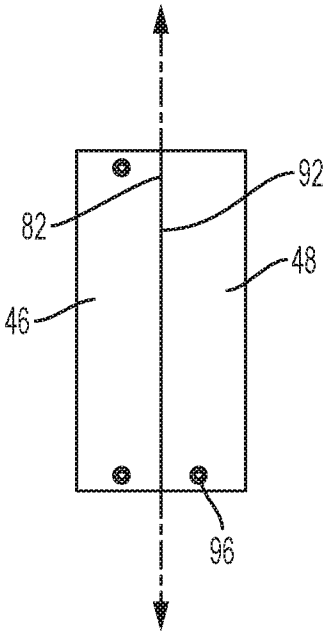
FIG. 11 is a schematic top-view-illustration of the primary blade and the secondary blade of the cutting mechanism of FIG. 2, with the primary blade in the cut position, corresponding to the cut position of the primary blade in FIG. 8.
Figure 10:
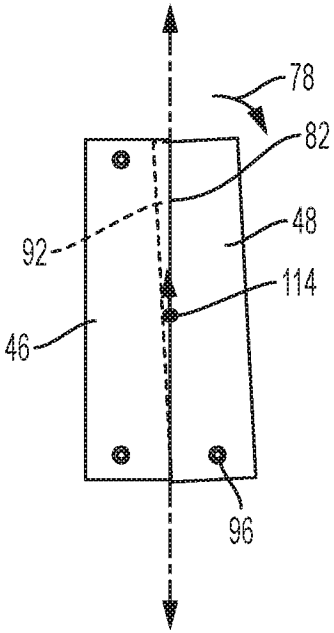
FIG. 10 is a schematic top-view-illustration of the primary blade and the secondary blade of the cutting mechanism of FIG. 2, with the primary blade in the intermediate position, corresponding to the intermediate position of the primary blade in FIG. 7.
Figure 9:
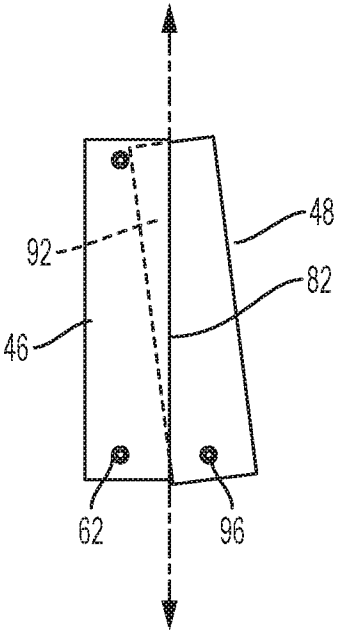
FIG. 9 is a top view-illustration of the primary blade and a secondary blade of the cutting mechanism of FIG. 2, with the primary blade in the ready position, corresponding to the ready position of the primary blade in FIG. 6.

Turning now to FIGS. 5-11, the cutting mechanism 40 is shown in various stages of use to further illustrate relative movement of the opposed blades 44. FIGS. 6-8 show front views taken through the cross-section A-A of FIG. 5. FIGS. 9-11 show schematic top-view-illustrations of the blades 46 and 48. In FIGS. 9-11, the driven blade 46 translates into the page towards biased blade 48.

In use, the driven blade 46, and particularly the driven cutting edge 82, is movable between a ready position shown in FIGS. 6 and 9 and a cut position shown in FIGS. 8 and 11. The driven cutting edge 82 also moves through an intermediate position shown in FIGS. 7 and 10, disposed between the ready position and the cut position of the driven cutting edge 82.

In the ready position of the driven cutting edge 82 (FIGS. 6 and 9), the biased cutting edge 92 is biased across a movement path of the driven cutting edge 82, such as across the driven path 47. This is because via the biasing members 110, absent contact with the driven cutting edge 82, the biased cutting edge 92 is aligned at a bias to the driven cutting edge 82 of the driven blade 46.

Additionally, at the ready position of the driven cutting edge 82, the driven cutting edge 82 and the biased cutting edge 92 are not in contact. In some embodiments, via alignment adjustments of one or both of the biased blade 48 and the driven blade 46, the blades 46 and 48 may already be in contact at a ready position of the driven blade 46 in other embodiments.

As the driven cutting edge 82 is translated into its intermediate position (FIGS. 7 and 10) the driven cutting edge 82 and the biased cutting edge 92 come into contact or engagement with one another. Contact of the driven blade 46 with the biased blade 48 effects movement of the biased blade 48 (FIGS. 8 and 11). The advancing driven blade 46 causes the biased blade 48 to pivot about the pivot axis 96 against a biasing force of the biasing members 110, and in a direction of movement away from the driven blade 46, such as out of the driven path 47.

The driven cutting edge 82 and the biased cutting edge 92 engage at a contact point, also herein referred to as a shear point 114 (FIG. 10). The shear point traverses lengths of both of the driven cutting edge 82 and the biased cutting edge 92, as the driven blade 46 moves the biased blade 48 against its direction of bias away from the driven blade 48. The unique arrangement of the driven blade 46 and the biased blade 48 provides a scissor-like cutting or shearing of the sheet stock material drawable between the opposed blades 44.

Via the biasing of the secondary or biased blade 48, change in relative alignment of the opposed cutting edges 82 and 92, due to wear of one or both of the opposed cutting edges 82 and 92, is accounted for over repeated use. As a result, the cutting mechanism 40 generally requires less maintenance, such as replacement of blades. Realignment of one or both of the opposed blades 46 and 48 is minimized, such as when a clean cut is not being made through the sheet stock material. In some embodiments, either of the primary blade 46 or the secondary blade 48 could be a driven blade with the other of the blades being a biased blade.

Figure 12:
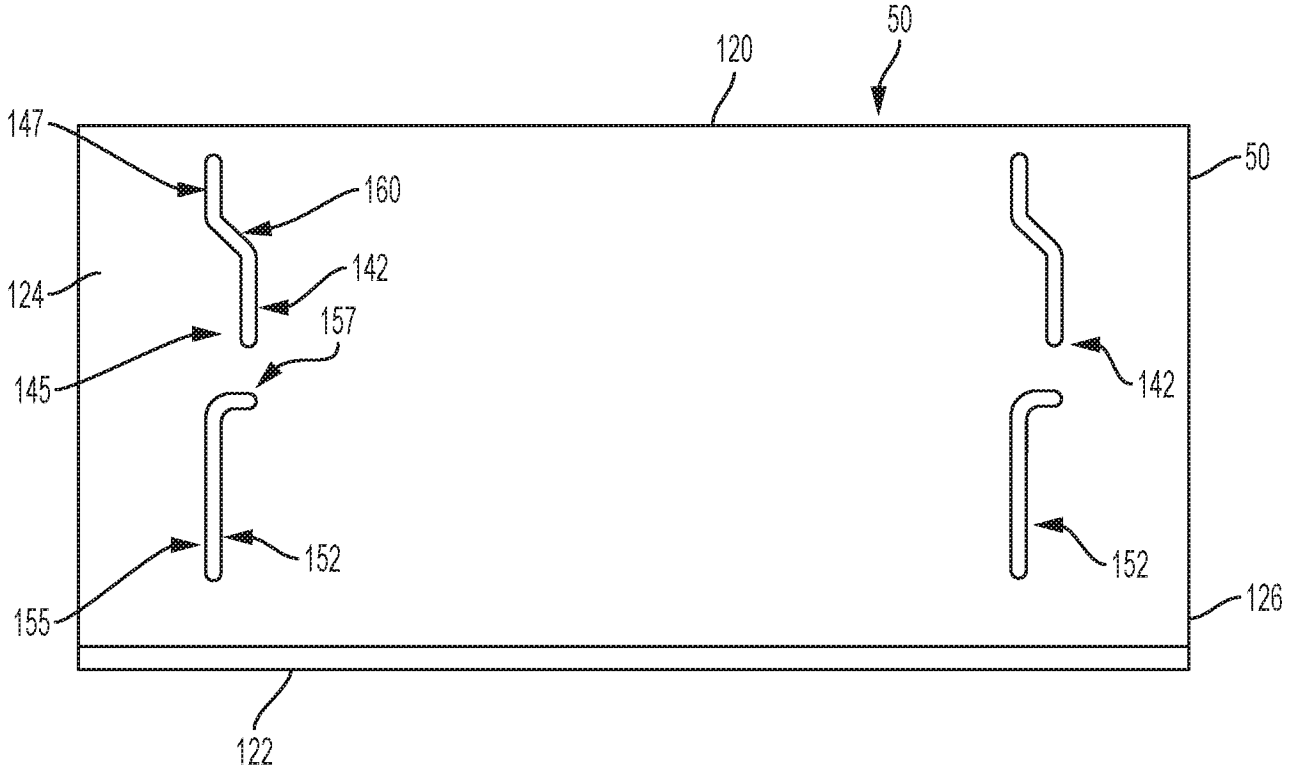
FIG. 12 is a front view of the blade guard of the cutting mechanism of FIG. 2, removed from the remainder of the cutting mechanism.
Figure 13:
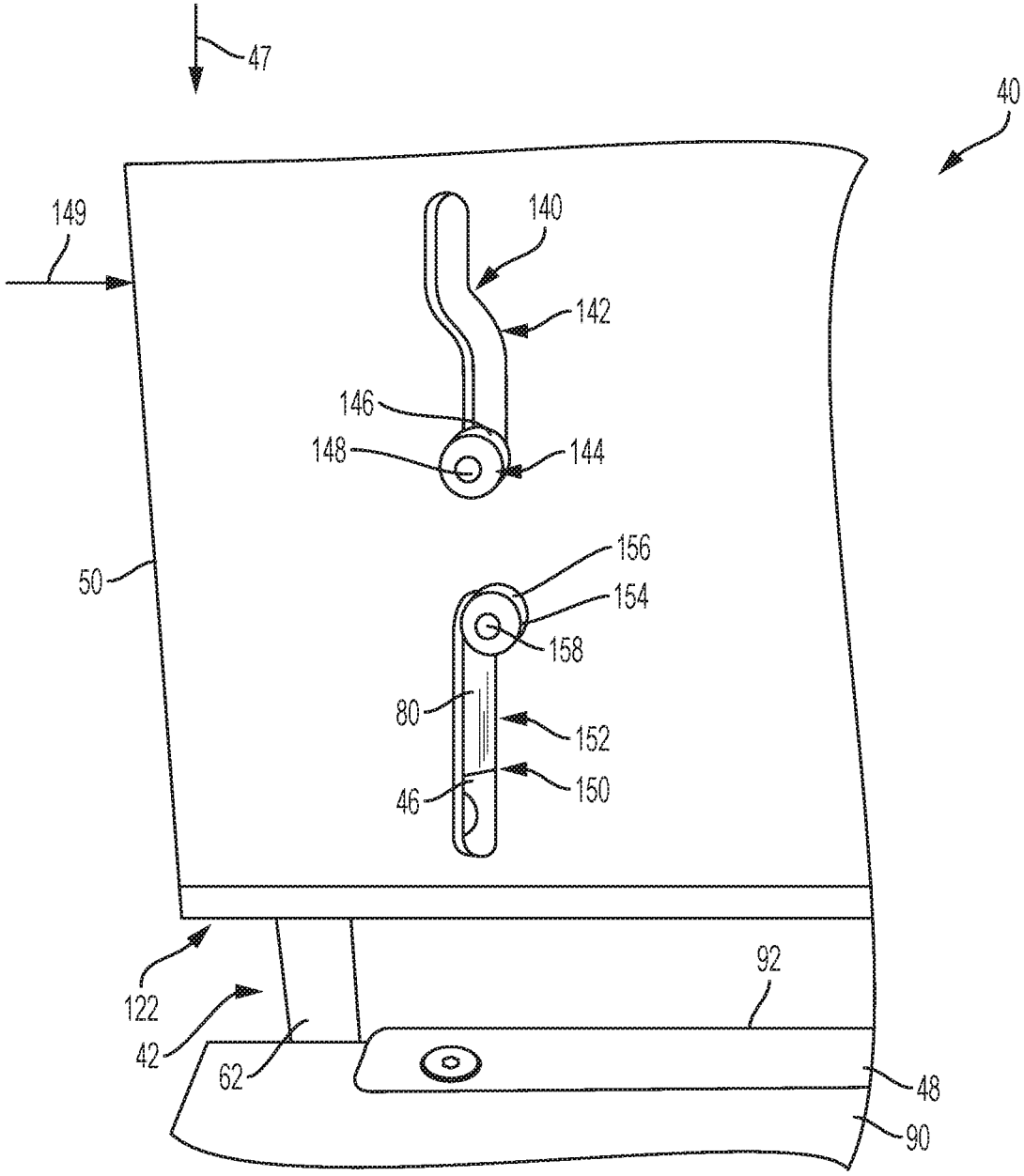
FIG. 13 is a partial front perspective view of the cutting mechanism of FIG. 2.
Figure 14:
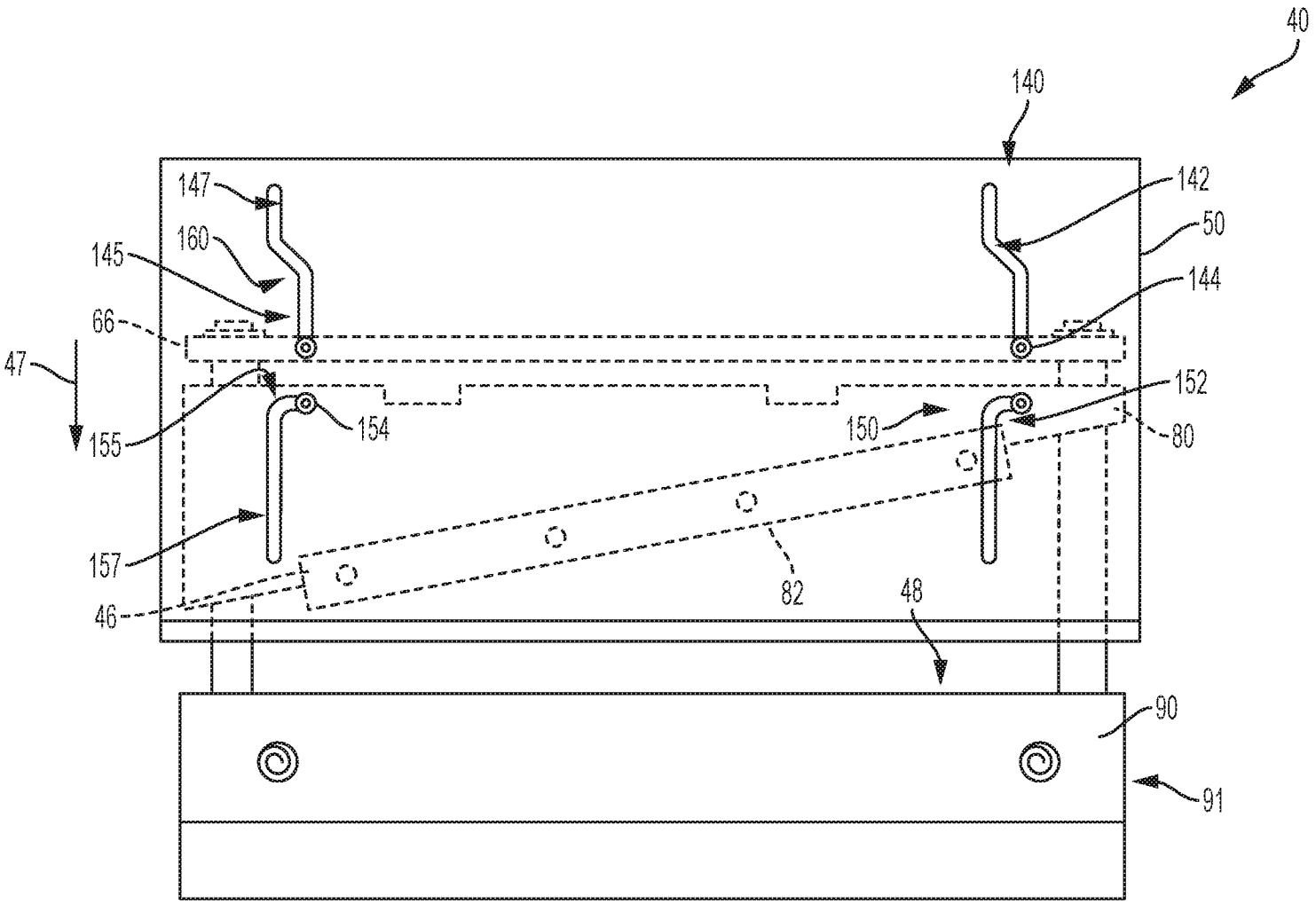
FIG. 14 is a front view of the cutting mechanism of FIG. 2 with the primary blade in the ready position.
Figure 16:
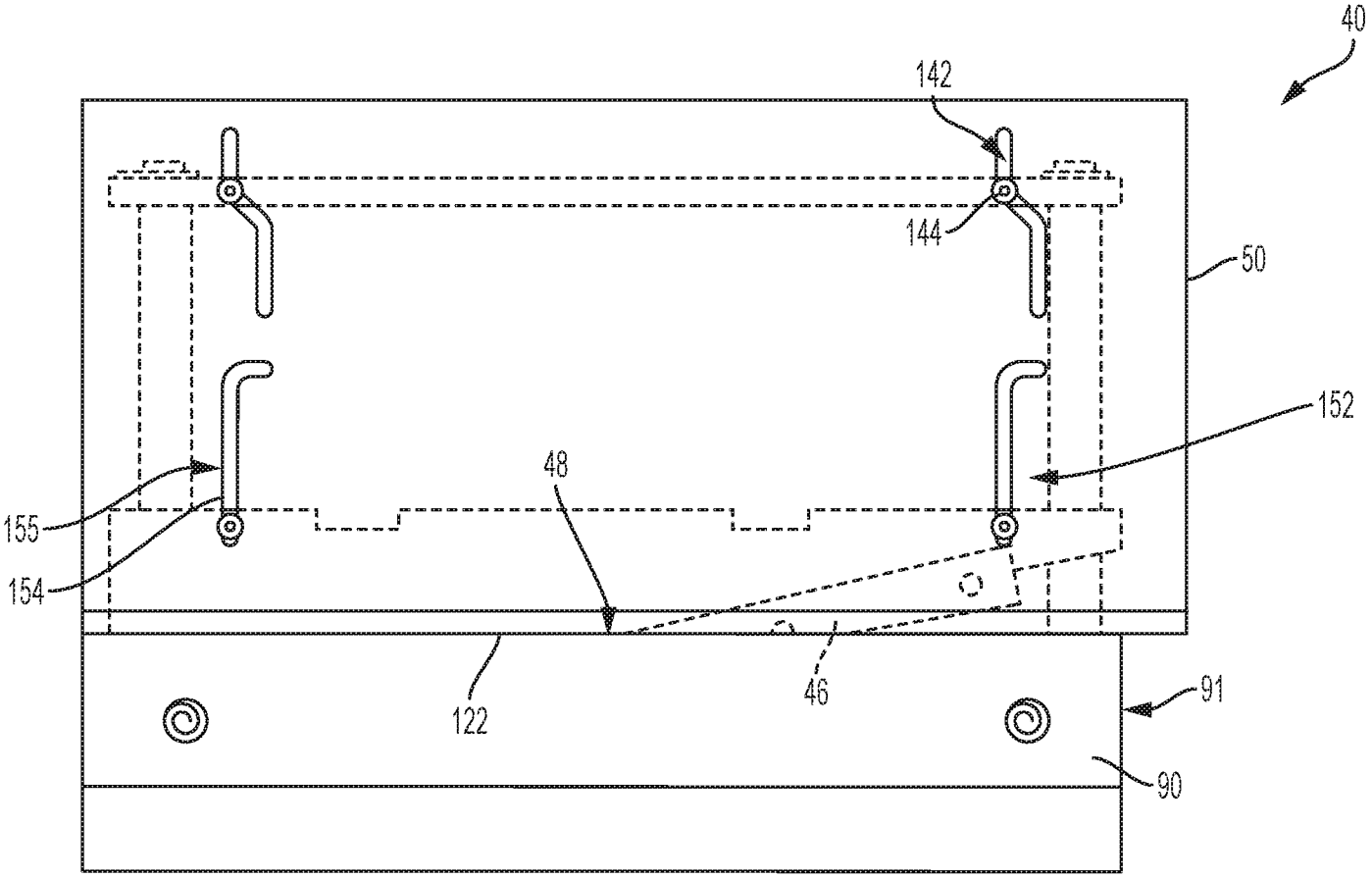
FIG. 16 is a front view of the cutting mechanism of FIG. 2 with the primary blade in the final position.

Referring now to FIGS. 12-14, the blade guard 50 will be described in detail. The blade guard 50 is generally configured to be coupled between the frame 42 and the driven blade 46. Via this coupling, the blade guard 50 is configured for common movement with the driven blade 46 during at least part of the translation of the driven blade 46 between its ready position (FIGS. 6 and 14) and its cut position (FIGS. 8 and 16). Likewise, via this coupling, the blade guard 50 is also configured for independent movement separate from the driven blade 46 during another part of the stroke of the driven blade 46.

The blade guard 50 projects along the driven blade 46 in a longitudinal direction between an upper edge 120 and a lower edge 122, opposite the upper edge 120. The blade guard 50 also projects in a lateral direction between opposed lateral sides 124 and 126. The upper edge 120, lower edge 122 and opposed lateral sides 124 and 126 define an outer periphery 130 of the blade guard.

The movement of the blade guard 50 and the driven blade 46 are coordinated through key and slot connections. Generally, the cutting mechanism 40 includes a pair of opposed laterally-spaced first slot and key arrangements 140 and a pair of opposed laterally-spaced second slot and key arrangements 150. In other embodiments, one or more of either of the first slot and key arrangement 140 and the second slot and key arrangement 150 may be used. While the blade guard 50 is shown as including the slots, the blade guard 50 may include the keys in other embodiments.

The first slot and key arrangement 140 slidably couples the blade guard 50 to the frame 42. The blade guard 50 includes a slot 142 that guides movement of the blade guard 50 independent from and relative to the frame 42. A key 144, such as a fastener 144 or other protrusion, is coupled to the frame 42, for example via threading. The fastener 144 is coupled to the stop member 66, but may be coupled to another suitable location of the frame 42 in other embodiments. A washer 146 may be disposed between a head 148 of the fastener 144 and the blade guard 50, to enable efficient sliding of the blade guard 50 relative to the frame 42.

The slot 142 is an S-shaped slot having an upper S-portion 147 and a lower S-portion 145 extending generally parallel to the direction of movement of the driven blade 46. An S-transition region 160 of the S-shaped slot 142 is disposed between the upper S-portion 147 and the lower S-portion 145. The upper S-portion 147 and the lower S-portion 145 are laterally offset, such that movement of the key through the transition portion causes the blade guard 50 to laterally shift relative to the frame 42.

The shift is in a direction 149 transverse a direction of common movement with the driven blade 46, which is along the driven path 47. The transverse shifting direction 149 is illustrated as orthogonal the driven path 47, though may be otherwise aligned in other embodiments, such as due to alternative slot constructions.

The second slot and key arrangement 150 slidably couples the blade guard 50 to the driven assembly 81, generally. More particularly, the blade guard 50 is coupled to the driven blade 46 via the driven carriage 80, and the blade guard includes a slot 152 that guides both common and independent movement of the blade guard relative to the driven blade 46. A key 154, such as a fastener 154 or other protrusion, is coupled to the driven assembly 81, for example via threading. The fastener 154 is coupled to the driven carriage 80, but may be coupled to another suitable location of the driven assembly 81 in other embodiments. A washer 156 may be disposed between a head 158 of the fastener 154 and the blade guard 50, to enable efficient sliding of the blade guard 50 relative to the frame 42.

The slot 152 is an inverted L-shaped slot, having a relatively longer L-portion 157 extending along a direction parallel to the translation direction of the driven blade 46. The slot 152 also has a relatively shorter L-portion 155 aligned transverse the relatively longer L-portion 157 and transverse the driven path 47, such as orthogonal to the relatively longer L-portion 157 and orthogonal to the driven path 47. Generally, when the blade guard 50 is caused to transversely shift due to movement of the blade guard 50 related to the S-shaped slot 142, the fastener 154 transitions from the relatively shorter L-portion 155 to a relatively longer L-portion 157.

Figure 15:
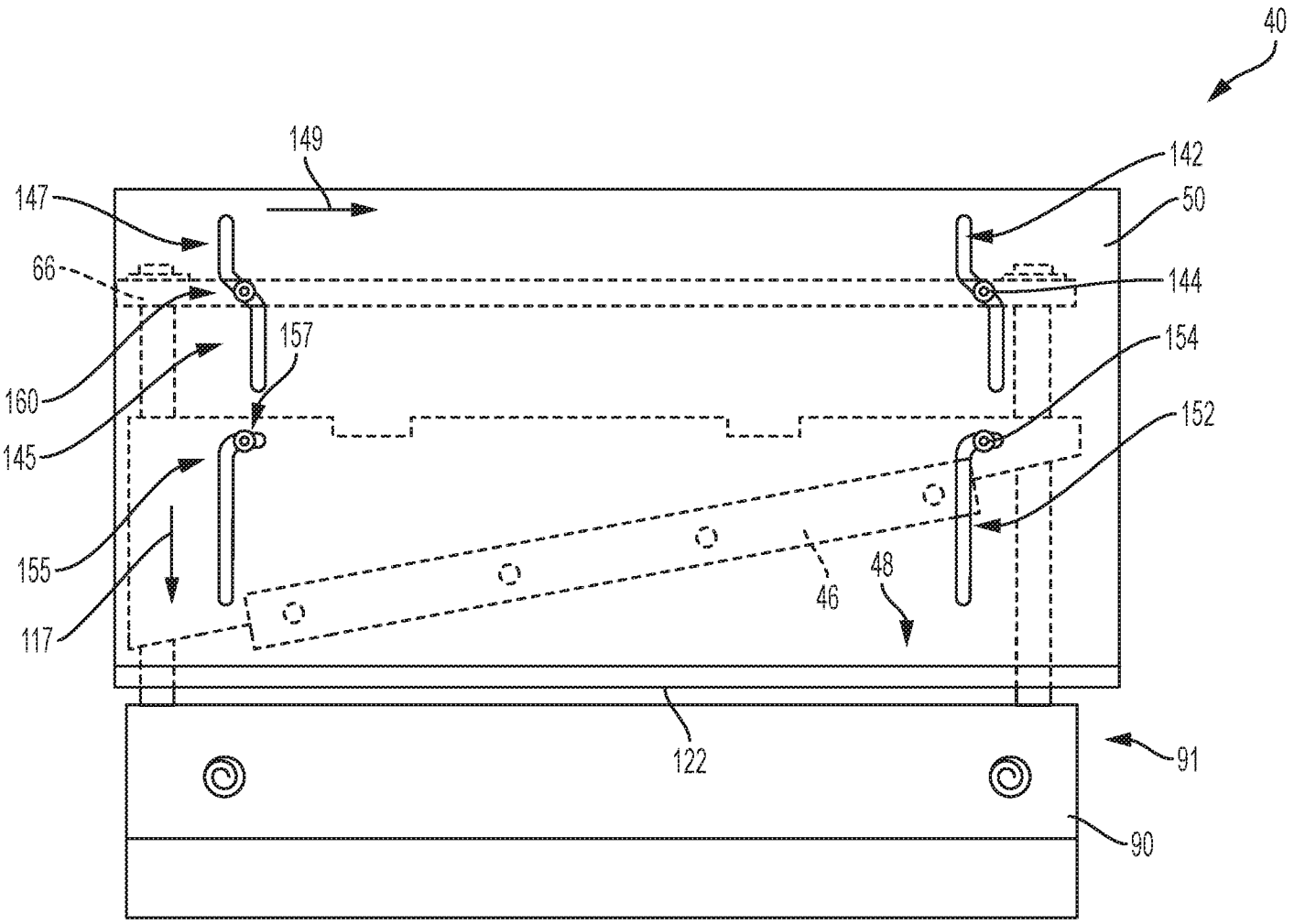
FIG. 15 is a front view of the cutting mechanism of FIG. 2 with the primary blade in the intermediate position.

Turning next to FIGS. 14-16, the cutting mechanism 40 including the blade guard 50 is shown in various stages of use to further illustrate relative movement of the blade guard 50 and the driven blade 46. The blade guard 50 moves between an engaged position (FIG. 14) and a disengaged position (FIGS. 15 and 16).

With respect to the driven blade 46, the blade guard 50 moves between an engaged position, where the blade guard 50 is commonly movable with the driven blade 46, to a disengaged position, where the driven blade 46 translates separately from the blade guard 50. The outer periphery 130 of the blade guard 50 projects beyond the driven blade 46, and beyond the driven cutting edge 82 when the blade guard 50 is in the engaged position. Thus common movement of the blade guard 50 with the driven blade 46 restricts cutting of the sheet stock material and engagement of the driven cutting edge 82 with the biased cutting edge 92 while the blade guard 50 is in the engaged position.

Specifically, the blade guard 50 is located to at least partially cover, and in the depicted embodiment to fully project beyond, the driven cutting edge 82 until the driven cutting edge 82 of the driven blade 46 is within a predetermined distance of the biased cutting edge 92 of the biased blade 48. The predetermined distance may be in the range of about 10 mm to about 3 mm, and preferably may be less than about 5 mm.

Looking to FIG. 14, when the driven blade 46 is in the ready position, the blade guard 50 is in the engaged position. The outer periphery 130 of the blade guard 50 projects beyond the driven cutting edge 82, such that the lower edge 122 of the blade guard 50 is nearer the biased blade 48 than the driven blade 46 is with respect to the biased blade 48.

In the engaged position of the glade guard 50, the fastener 144 is in the lower S-portion 145 of the S-shaped slot 142, and the fastener 154 is in the relatively shorter L-portion 155 of the L-shaped slot 152. Because the fastener 154 is coupled in the relatively shorter L-portion 155 of the L-shaped slot 152, the blade guard 50 translates along with the driven blade 46 as the driven blade 46 is translated in the driven direction 47. Accordingly, the L-shaped slot 154 is shaped to maintain the common movement of the blade guard 50 and the driven blade 42 during at least part of the cutting operation.

As the blade guard 50 moves from the engaged position of FIG. 14 to the disengaged position shown in both FIGS. 15 and 16, the fastener 144 moves through the lower S-portion 145 of the S-shaped slot 142, towards the upper S-portion 147. As the driven blade 146 continues to drive the blade guard 50, the fastener 144 continues towards the S-transition region 160 of the S-shaped slot 142, between the lower S-portion 145 and the upper S-portion 147.

Looking next FIG. 15, the driven blade 46 is driven into the intermediate position. When the fastener 144 is moved into the S-transition region 160 of the S-shaped slot 142, the blade guard 50 is caused to transversely shift along the shifting direction 149 to its disengaged position.

Consequently, when the blade guard 50 shifts relative to the frame 42, the fastener 154 moves relative to the blade guard 50 from the relatively shorter L-portion 147 of the L-shaped slot 152 to the relatively longer L-portion 145. Once the fastener 145 transitions to the relatively longer L-portion 145, the driven blade 46 is enabled to move separately from the blade guard and vice versa.

In the initial disengaged position of the blade guard 50 of FIG. 15, the lower edge 122 of the blade guard 50 is near but not yet abutting the biased assembly 91. Alternative slot configurations may change this positioning in other embodiments.

Looking last to FIG. 16, in the latter disengaged position of the blade guard 50, the lower edge 122 of the blade guard is now abutting the biased assembly 91 and projects beyond the outer periphery 130 of the blade guard 50. The fastener 154 travels along the relatively longer L-portion 145 of the L-shaped slot 152 such that the driven blade 46 to which the fastener 154 is coupled may reach the cut position.

In the illustrated embodiment, the biasing element 88 (FIG. 4) may cause the driven blade 46 to be returned to the ready position, in turn shifting the blade guard 50 along a reverse shifting direction (opposite the shifting direction 149) and into common movement with the driven blade 46 as the driven blade 46 returns from the cut position, through the driven blade's intermediate position to the ready position. Likewise, as the driven blade 46 is returned to the ready position, the biased blade 48 may be spring-biased back into the driven path 47 via the biasing members 110.

In one summary, the present invention provides a cutting mechanism 34, 40 for a dunnage conversion machine 20 that selectively cuts dunnage sheet stock drawable through the cutting mechanism 34, 40. The cutting mechanism 34, 40 includes a frame 42, a driven cutting means 46, 82 supported relative to the frame 42, and a self-adjustable cutting means 48, 92 also supported relative to the frame 42. The self-adjustable cutting means 48, 92 is arranged to self-adjust its position relative to the driven cutting means 46, 82 to account for wear of at least one of the driven cutting means 46, 82 and the self-adjustable cutting means 48, 92. The driven cutting means 46, 82 and the self-adjustable cutting means 48, 92 are engageable with one another to cut the sheet stock drawable between the driven cutting means 46, 82 and the self-adjustable cutting means 48, 92. A guarding means 50 is arranged to project beyond a driven cutting edge 82 of the driven cutting means 48, 82 to restrict movement of the driven cutting edge 82 beyond an outer periphery 130 of the guarding means 50 until the driven cutting edge 82 is within a predetermined distance from a cutting edge 92 of the self-adjustable cutting means 48, 92.

Summarized another way, the present invention provides a cutting mechanism 34, 40 for a dunnage conversion machine 20 that selectively cuts dunnage sheet stock 24 drawable through the cutting mechanism 34, 40. The cutting mechanism 34, 40 includes a frame 42 and a pair of opposed cutting blades 44 through which the bulk supply of dunnage 24 is drawable. The cutting blades 44 include a driven blade 46 and a biased blade 48, each supported relative to the frame 42 for movement into and out of contact with one another. The driven blade 46 is movable towards the biased blade 48 to cut the sheet stock 24. The biased blade 48 is biased against movement away from the driven blade 46 to allow for self-adjustability to counter wear of one or both of the opposed blades 44. Contact of the opposed blades 44 with one another causes the biased blade 48 to be deflected away from the driven blade 46.

Although the invention has been shown and described with respect to certain embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

The invention claimed is:

1. A cutting mechanism for a dunnage conversion machine that selectively cuts dunnage sheet stock drawable through the cutting mechanism, the cutting mechanism comprising:

a frame;

a driven blade supported relative to the frame for movement in a movement direction towards a biased blade and across a sheet stock path along which the dunnage sheet stock is movable through the cutting mechanism, to cut the sheet stock into discrete lengths;

wherein the driven cutting blade has a driven cutting edge that lies in a cutting plane that includes the movement direction, the driven cutting edge extending in a direction transverse the movement direction, and wherein the biased blade has a biased cutting edge that lies in a biased plane that is transverse to the cutting plane, the biased blade being supported relative to the frame for pivoting movement towards and away from the driven blade, the biased blade being biased against movement away from the driven blade where contact of the driven blade with the biased blade effects pivoting movement of the biased blade against a biasing force in a bias direction away from the driven blade, the biased plane being defined by the biased cutting edge which remains in the biased plane through the pivoting movement of the biased blade.

2. The cutting mechanism of claim 1, where the driven blade is linearly translatable towards the biased blade.

3. The cutting mechanism of claim 1, wherein the driven cutting edge is linearly translatable between a ready position and a cut position removed from the ready position and in contact with the biased cutting edge, and contact of the blades with one another occurs at a shear point that traverses an edge length of the biased cutting edge as the driven cutting edge moves between the ready position and the cut position and causes the biased blade to pivot and cut the sheet stock at the shear point.

4. The cutting mechanism of claim 3, where the biased cutting edge is biased to a position where the cutting edge extends across the cutting plane when the driven cutting edge is in the ready position, the cutting plane defining a movement path of the driven cutting edge.

5. The cutting mechanism of claim 3, where contact of the driven cutting edge with the biased cutting edge effects movement of the biased cutting edge out of a movement path of the driven cutting edge.

6. The cutting mechanism of claim 3, where each of the driven cutting edge and the biased cutting edge are linear edges.

7. The cutting mechanism of claim 1, where the driven cutting edge is movable in the cutting plane between a ready position and a cut position removed from the ready position, the biased blade being pivotable about an axis that is parallel to the movement direction of the driven blade, such that an interior angle between the cutting plane and the biased cutting edge decreases as the cutting blade moves from the ready position to the cut position.

8. A dunnage conversion machine, comprising:

a conversion assembly that converts dunnage sheet stock into a relatively less-dense dunnage product, and a cutting mechanism as set forth in claim 1, for cutting the sheet stock.

9. A cutting mechanism for a dunnage conversion machine that selectively cuts dunnage sheet stock drawable through the cutting mechanism, the cutting mechanism comprising:

a frame;

a driven blade supported relative to the frame for movement in a movement direction towards a biased blade and across a sheet stock path along which the dunnage sheet stock is movable through the cutting mechanism, to cut the sheet stock into discrete lengths;

wherein the driven cutting blade has a driven cutting edge that lies in a cutting plane that includes the movement direction, and the biased blade has a biased cutting edge that lies in a biased plane that is nonperpendicular to the movement direction, the biased blade being supported relative to the frame for pivoting movement towards and away from the driven blade, the biased blade being biased against movement away from the driven blade where contact of the driven blade with the biased blade effects pivoting movement of the biased blade against a biasing force in a bias direction away from the driven blade; and a blade guard coupled between the frame and the driven blade, the blade guard configured to be commonly movable with the driven blade between an engaged position of the blade guard and a disengaged position of the blade guard, and the blade guard configured to restrict cutting of the sheet stock and movement of the driven blade separate from the blade guard until the blade guard is moved to the disengaged position.

10. The cutting mechanism of claim 9, where the blade guard is arranged to project beyond the driven cutting edge to restrict movement of the driven cutting edge beyond an outer periphery of the blade guard until the driven cutting edge is within a predetermined distance from the biased cutting edge.

11. The cutting mechanism of claim 10, where the predetermined distance is less than about 5 mm.

12. The cutting mechanism of claim 9, where the blade guard is configured to shift in a direction transverse a direction of common movement with the driven blade, once the blade guard is moved to the disengaged position.

13. The cutting mechanism of claim 9, further including a slot and key arrangement for guiding movement of the blade guard and the driven blade relative to one another, one of the blade guard and the driven blade including the key of the arrangement, and the other of the blade guard and the driven blade including the slot of the arrangement, where the slot is shaped to maintain common movement of the blade guard and the driven blade until the blade guard is in the disengaged position, and thereafter to allow movement of the driven blade independent from the blade guard.

14. The cutting mechanism of claim 13, where the slot and key arrangement includes two slots and two corresponding keys, the two slots including an S-shaped slot guiding independent movement of the blade guard relative to the frame and an L-shaped slot guiding both common movement of the blade guard with the driven blade and independent movement of the blade guard separate from the driven blade.

* * * * *